US005660067A

United States Patent [19]

Liao

[11] Patent Number: 5,660,067

[45] Date of Patent: Aug. 26, 1997

[54] VERSATILE SPRING MAKING MACHINE

[76] Inventor: Chen-Nan Liao, No. 6, Lane 293, Hsin-Shu Road, Hsin-Chuang City, Taipei Hsien, Taiwan

[21] Appl. No.: 524,795

[22] Filed: Sep. 7, 1995

[51] Int. Cl.[6] ..... B21F 3/10; B21F 3/02

[52] U.S. Cl. ..... 72/138; 72/140

[58] Field of Search ..... 72/133, 135, 138, 72/162, 137, 140, 145

[56] References Cited

U.S. PATENT DOCUMENTS

| | | | |
|---|---|---|---|
| 3,031,006 | 4/1962 | Fokkoinga | 72/138 |
| 3,541,827 | 11/1970 | Hansen | 72/138 |
| 4,947,670 | 8/1990 | Wu | 72/138 |
| 5,259,226 | 11/1993 | Itaya | 72/138 |

*Primary Examiner*—Lowell A. Larson
*Assistant Examiner*—Rodney A. Butler
*Attorney, Agent, or Firm*—Bo-In Lin

[57] ABSTRACT

A versatile spring making machine including a processing tool locating unit consisting of a transverse slide moved in the transverse direction and a longitudinal slide moved in the longitudinal direction, a tool assembly moved by the processing tool locating unit to the desired processing position for processing a steel wire into springs, a feeder unit having feeding rollers controlled to feed a steel wire to the tool assembly for processing, a material guiding unit having guiding rollers controlled to deliver a steel wire to the feeder unit, and a straightener unit disposed between the material guiding unit and the feeder unit and controlled to straighten the steel wire from the material guiding unit or to turn it axially.

3 Claims, 6 Drawing Sheets

VERSATILE SPRING MAKING MACHINE

BACKGROUND OF THE INVENTION

The present invention relates to spring making machines, and relates more particularly to a versatile spring making machine for making a variety of springs.

A variety of spring making machines have been developed for making different springs for different purposes. However, conventional spring making machines are still not satisfactory in function. One disadvantage of conventional spring making machines is that they are designed for making a specific type of spring. Therefore, different spring making machines must be used for making different springs. Another drawback of conventional spring making machines is that the working angle of the tool is not adjustable, therefore the processing angle is limited. Another drawback of conventional spring making machines is their heavy structure. Still another drawback of conventional spring making machines is that the steel wire tends to be tangled or curved when it is moved back. When the steel wire is not well straightened, detective springs will be produced.

SUMMARY OF THE INVENTION

The present invention has been accomplished to provide a versatile spring making machine which eliminates the aforesaid drawbacks. It is one object of the present invention to provide a versatile spring making machine which is suitable for making any of a variety of springs. According to one aspect of the present invention, the versatile spring making machine comprises a tool assembly having a variety of processing tools for different processing requirements. According to another aspect of the present invention, the versatile spring making machine further comprises a processing tool locating unit for moving the tool assembly to any of a variety of working positions for processing a steel wire into any of a variety of springs. According to still another aspect of the present invention, the versatile spring making machine further comprises a feeder unit for feeding a steel wire into position for processing into springs by the tool assembly, wherein the feeder unit comprises a plurality of feeding rollers, a motor, a transmission mechanism driven by the motor of the feeder unit to rotate the feeding rollers in feeding the steel wire, and a brake system controlled to move the feeding rollers between the working position and the non-working position. According to still another aspect of the present invention, the versatile spring making machine further comprises a material guiding unit for guiding a steel wire to the feeder unit for further processing by the tool assembly. According to still another aspect of the present invention, the versatile spring making machine further comprises a straightener unit disposed between the material guiding unit and the feeder unit and controlled to straighten the steel wire delivered from the material guiding unit through a set of straightening rollers thereof, or to spin the steel wire. According to still another aspect of the present invention, the versatile spring making machine further comprises a spinning tool assembly mounted on the processing tool locating unit for winding the steel wire into coil springs.

DETAILED DESCRIPTION OF THE PREFERRED EMBODIMENT

Figure 1:
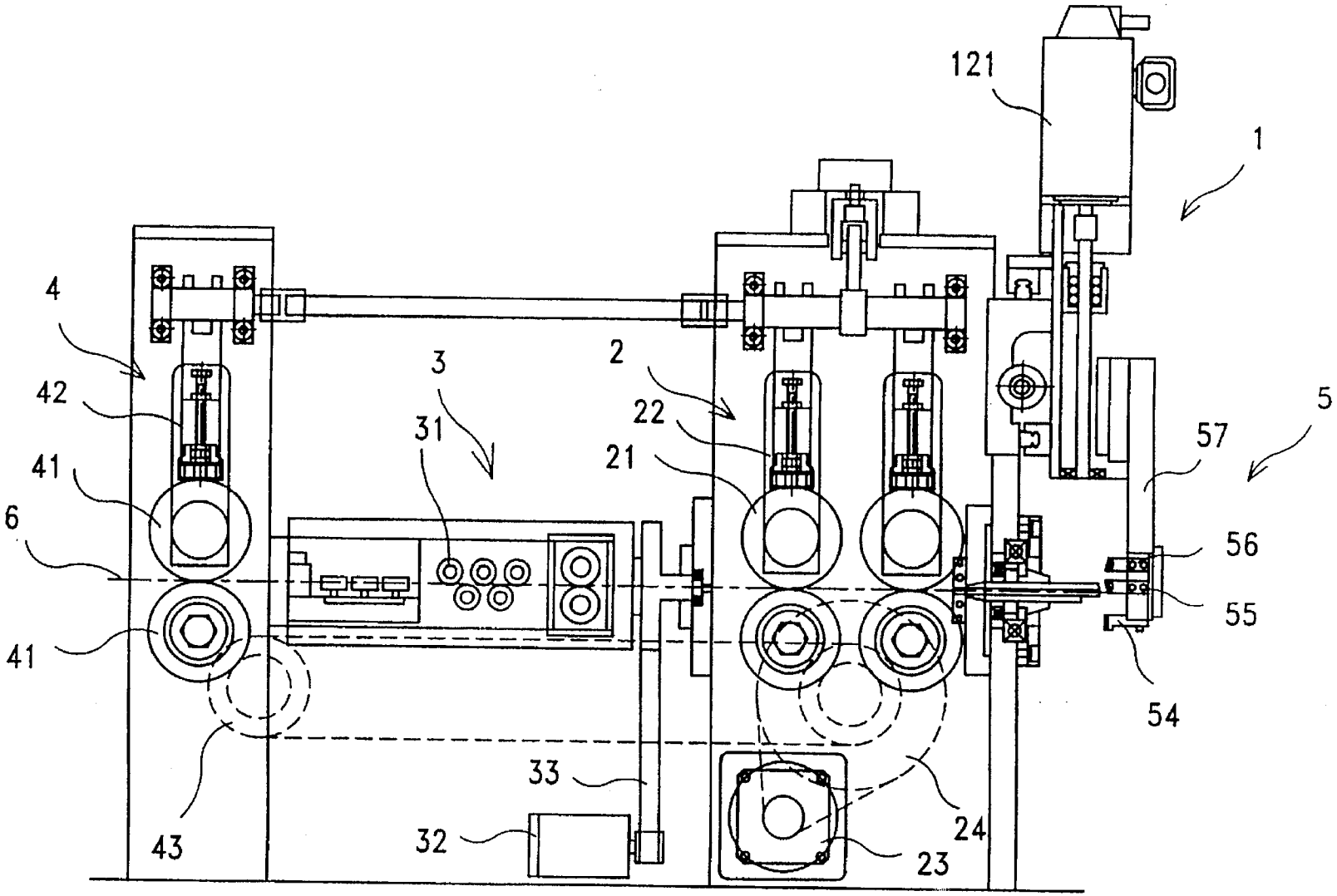
FIG. 1 is a side plain view of a versatile spring making machine according to the present invention.

Referring to the annexed drawings in detail, a versatile spring making machine in accordance with the present invention is generally comprised of a processing tool locating unit 1, feeder unit 2, a straightener unit 3, a material guiding unit 4, and a tool assembly 5.

Figure 2:
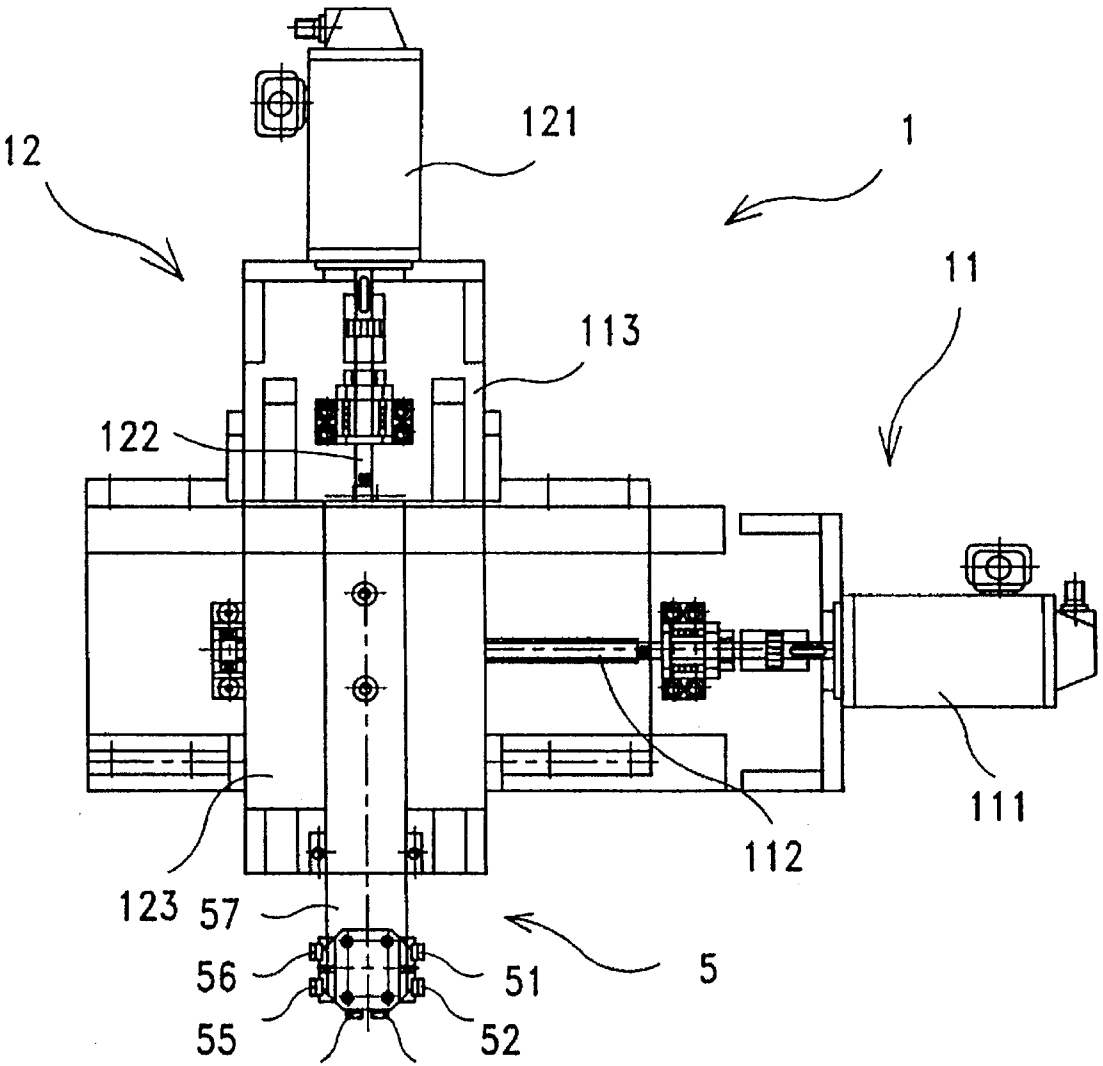
FIG. 2 is a plain view of the processing tool locating unit and the tool assembly for the versatile spring making machine according to the present invention.
Figure 3C:
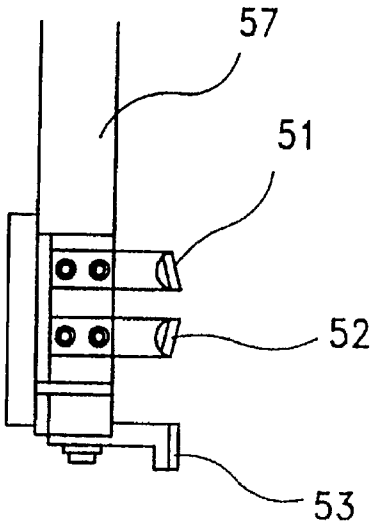
FIG. 3C is a right side view of the tool assembly according to the present invention.
Figure 3A:
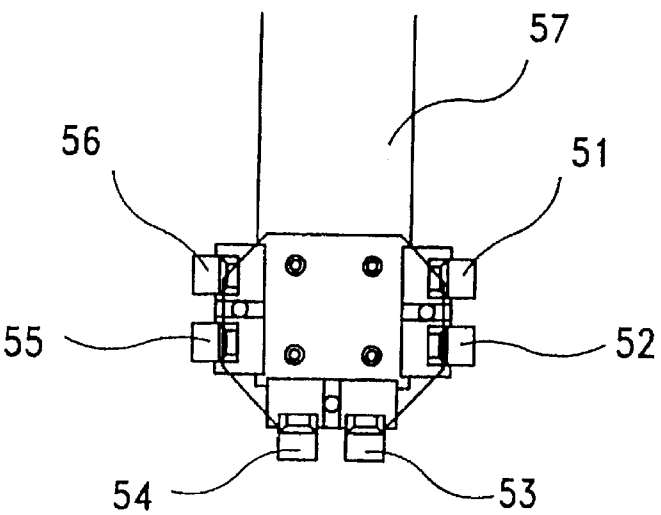
FIG. 3A is a front view of the tool assembly according to the present invention.
Figure 3B:
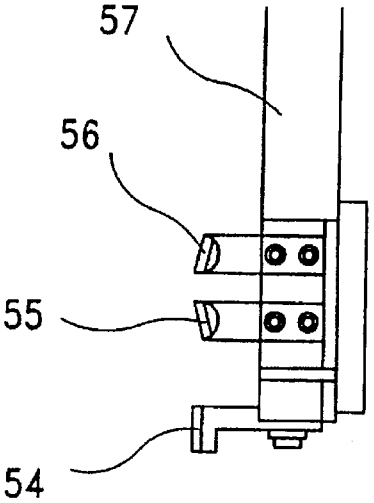
FIG. 3B is a left side view of the tool assembly according to the present invention.
Figure 3D:
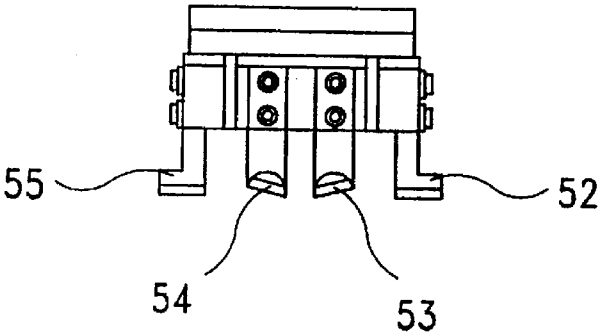
FIG. 3D is a bottom view of the tool assembly according to the present invention.

Referring to FIGS. 1 and 2, the processing tool locating unit 1 comprises a transverse locating device 11 and a longitudinal locating device 12. The transverse locating device 11 comprises a motor 111, a transverse screw rod 112 turned by the motor 111, and a transverse slide 113 mounted on the transverse screw rod 112 and forced to move along the transverse screw rod 112 when the transverse screw rod 112 is turned by the motor 111. The longitudinal locating device 12 is mounted on the transverse slide 113 of the transverse locating device 11, comprised of a motor 121, a longitudinal screw rod 122 turned by the motor 121, and a longitudinal slide 123 mounted on the longitudinal screw rod 122 and forced to move along the longitudinal screw rod 122 when the longitudinal screw rod 122 is turned by the motor 121. The tool assembly 5 is comprised of a tool holder 57 mounted on the longitudinal slide 123 of the processing tool locating unit 1, and a plurality of processing tools 51, 52, 53, 54, 55, and 56 respectively fastened to the tool holder 57. The feeder unit 2 comprises a plurality of feeding rollers 21, a motor 23, a transmission mechanism 24 driven by the motor 23 to rotate the feeding rollers 21, and a brake system 22 controlled to release the feeding rollers 21 from the steel wire 6 or to force the feeding rollers 21 into working position. The straightener unit 3 comprises a set of straightening rollers 31 for straightening the steel wire 6. The straightener unit 3 can also be turned axially by a motor 32 through a transmission mechanism 33 to spin the steel wire 6. The material guiding unit 4 is disposed in front of the straightener unit 3, comprised of a set of guiding rollers 41, a transmission mechanism 43 driven by the motor 23 of the feeder unit 2 to turn the guiding rollers 41, and a brake system 42 controlled to release the guiding rollers 41 from the steel wire 6 or to force the guiding rollers 41 into working position. The brake system 22, 42 can be a hydraulic cylinder or a pneumatic cylinder operated by hydraulic or pneumatic pressure. When the spring making machine is operated, the steel wire 6 is guided forwards to the straightener unit 3 by the guiding rollers 41 of the material guiding unit 4, then straightened by the straightening rollers 31 of the straightener unit 3, and then fed into the processing process by the feeding rollers 21 of the feeder unit 2 for processing into desired springs by the tool assembly 5 through the operation of the processing tool locating unit 1.

The motor 23 of the feeder unit 2 can also be controlled to turn the guiding rollers 41 of the material guiding unit 4 in the reversed direction to return the steel wire 6 to prevent the steel wire 6 from being forced to bend or gathered in the area between the straightener unit 3 and the feeder unit 2 when the process needs to draw back the steel wire 6 even a little bit. By means of controlling the brake systems 22 and 42, the feeding rollers 21 and the guiding rollers 41 can be released from the steel wire 6 for permitting the steel wire 6 to be turned axially by the straightener unit 3.

Referring to FIGS. 3A, 3B, 3C, and 3D, the processing tools 51, 52, 53, 54, 55, and 56 are arranged on the tool holder 57 around three sides, having different working faces for different processing purposes.

Figure 4:
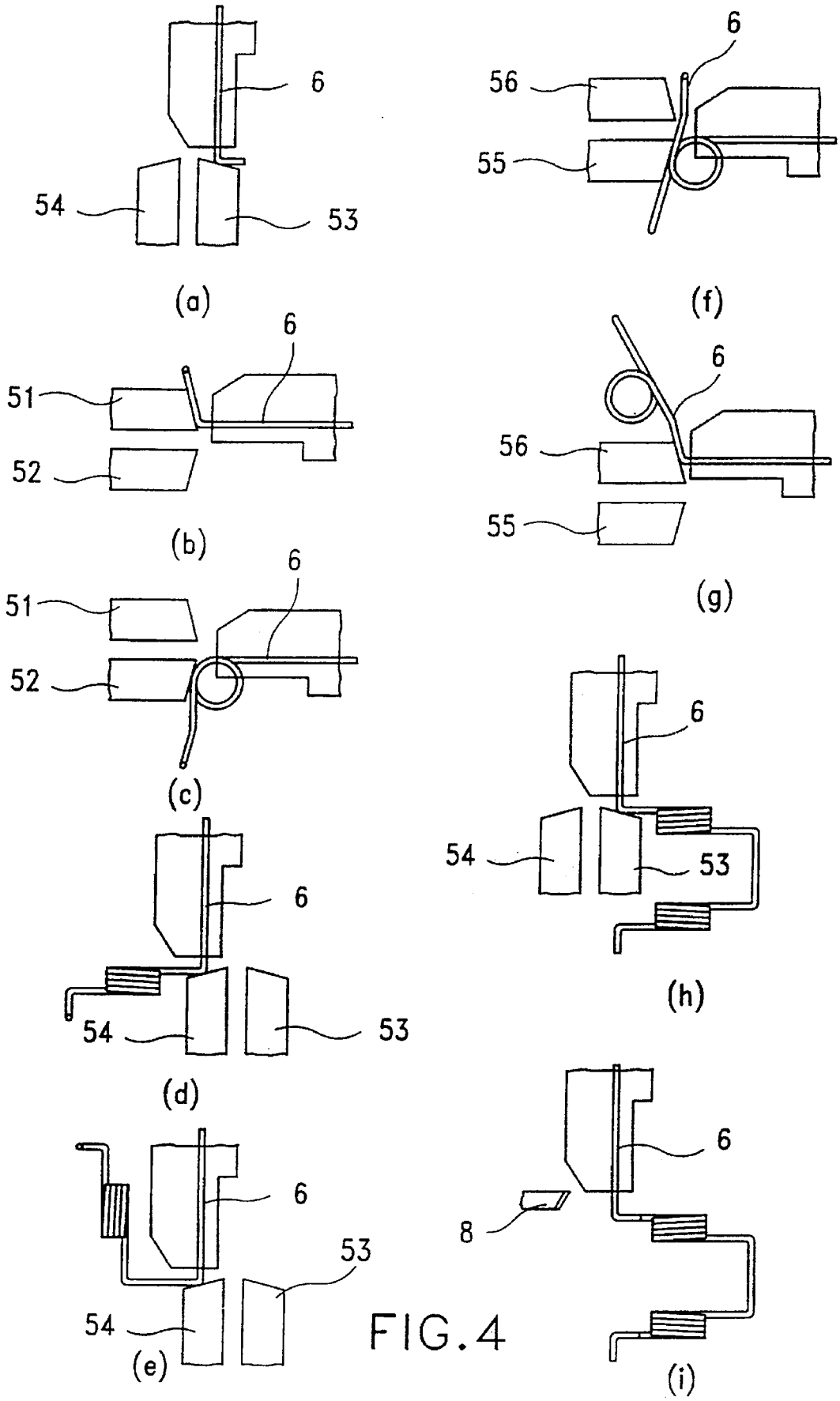
FIG. 4 is a production flow chart showing the processing of the processing tools of the tool assembly according to the present invention.
Figure 5:
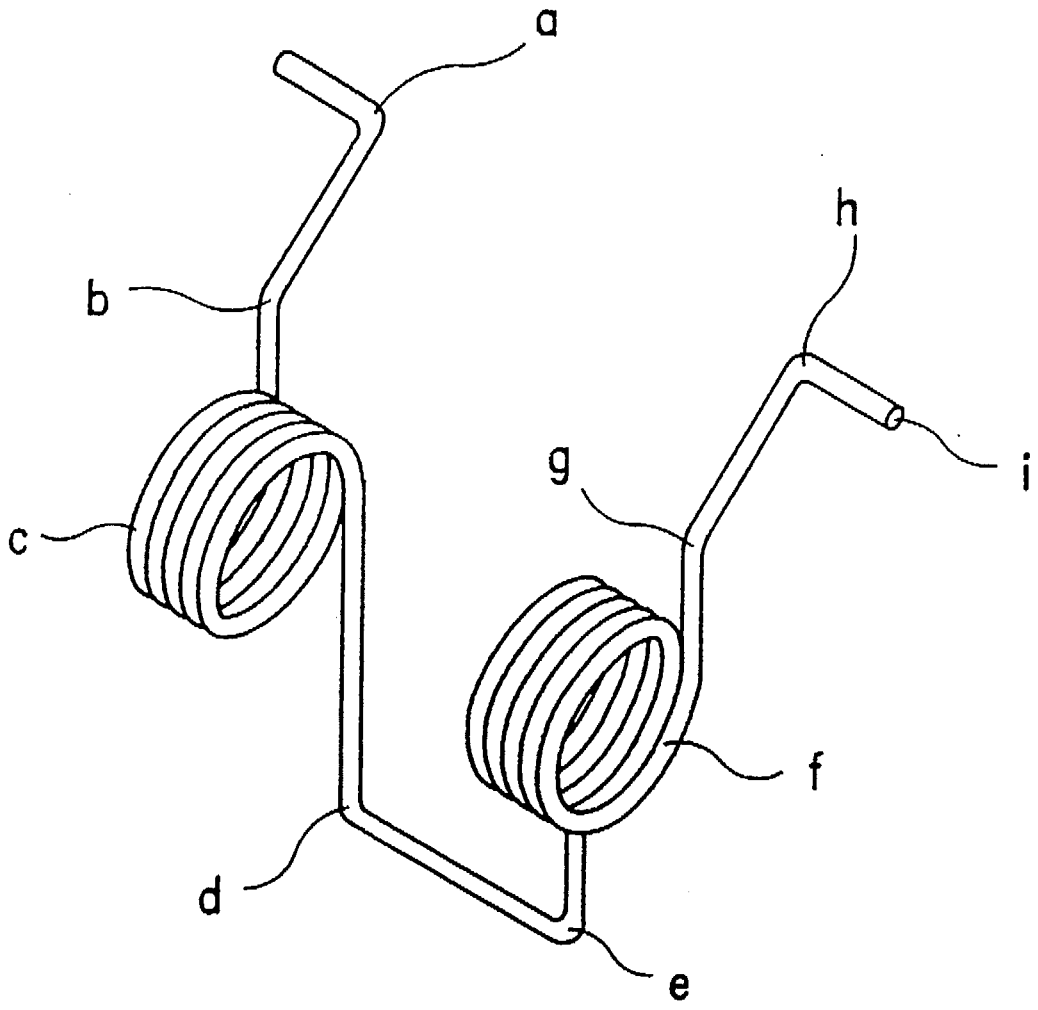
FIG. 5 is an elevational view of a finished spring made according to the processing process shown in FIG. 4.

FIGS. 4 and 5 show a processing example of the present invention, which includes the steps of (a) bending, (b) bending, (c) winding, (d) bending, (e) bending, (f) winding, (g) bending, (h) bending, and (i) cutting. The cutter 8 which is used to cut off the steel wire 6 when a spring is made is mounted at the front side of the machine at a suitable location.

Figure 6:
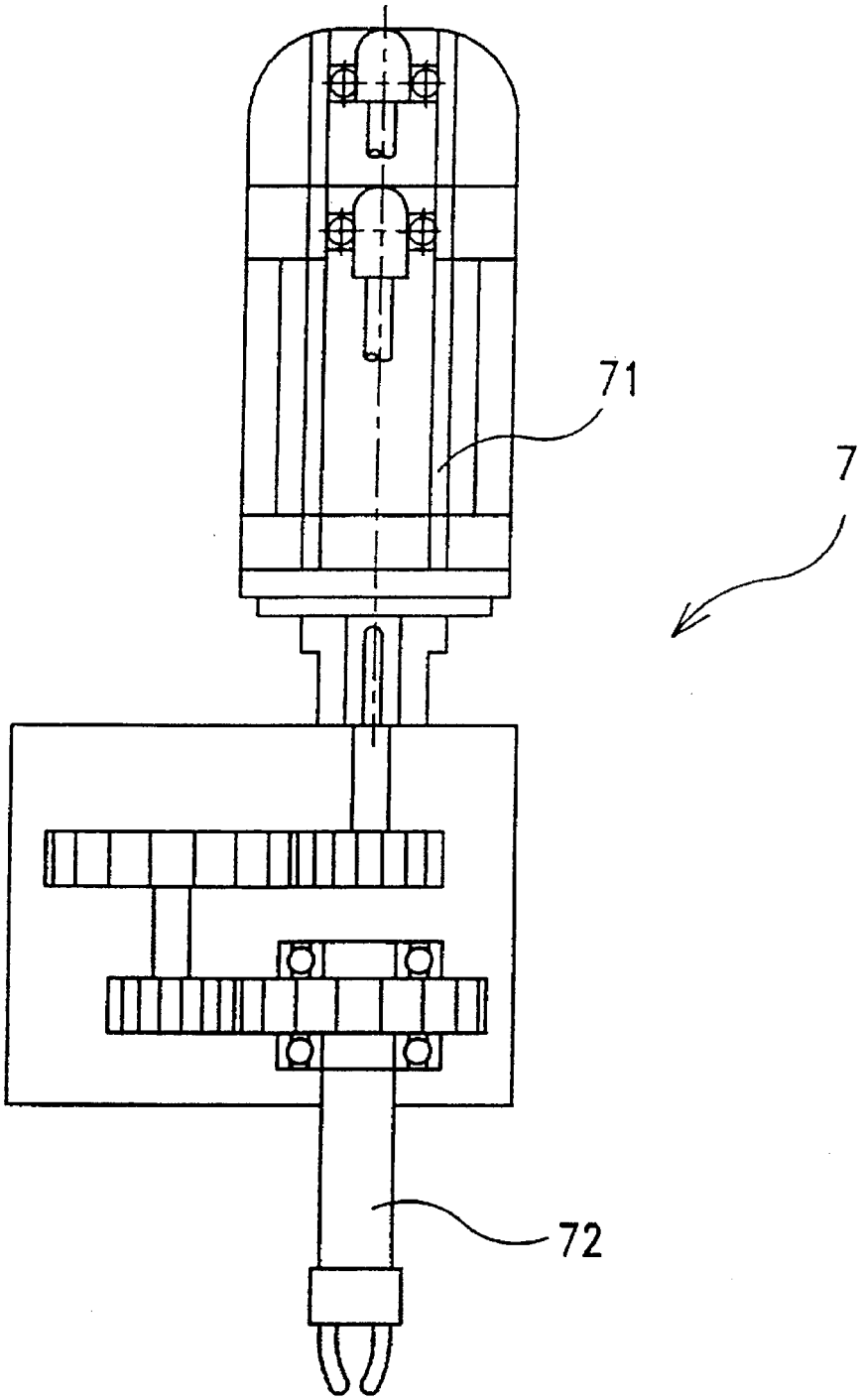
FIG. 6 shows a spinning tool assembly according to the present invention.

FIG. 6 shows a spinning tool assembly 7 for mounting on the longitudinal slide 123 of the processing tool locating unit 1 for winding the steel wire 6 into a coil spring. The spinning tool assembly 7 comprises a spinning tool 72, and a motor 71 controlled to turn the spinning tool 72.

It is to be understood that the drawings are designed for purposes of illustration only, and are not intended as a definition of the limits and scope of the invention disclosed.

I claim:

1. A versatile spring making machine comprising:

a processing tool locating unit, said processing tool locating unit comprising a transverse locating device and a longitudinal locating device, said transverse locating device comprising a transverse movement control motor, a transverse screw rod turned by said transverse movement control motor, and a transverse slide mounted on said transverse screw rod and forced to move along said transverse screw rod when said transverse screw rod is turned by said transverse movement control motor, said longitudinal locating device being mounted on the transverse slide of said transverse locating device, comprised of a longitudinal movement control motor, a longitudinal screw rod turned by said longitudinal movement control motor, and a longitudinal slide mounted on said longitudinal screw rod and forced to move along said longitudinal screw rod when said longitudinal screw rod is turned by said longitudinal movement control motor;

a tool assembly mounted on said processing tool locating unit and moved by it, said tool assembly comprising a tool holder mounted on the longitudinal slide of said processing tool locating unit, and a plurality of processing tools respectively fastened to said tool holder;

a feeder unit for feeding a steel wire into position for processing into springs by said tool assembly, said feeder unit comprising a plurality of feeding rollers, a motor, a transmission mechanism driven by the motor of said feeder unit to rotate said feeding rollers in feeding said steel wire, and a brake system controlled to move said feeding rollers between a working position and a non-working position;

a material guiding unit for guiding a steel wire to said feeder unit for further processing by said tool assembly; and a straightener unit disposed between said material guiding unit and said feeder unit and controlled to straighten said steel wire delivered from said material guiding unit through a set of straightening rollers thereof and to deliver said straightened steel wire to said feeder unit.

2. The versatile spring making machine of claim 1 further comprising a motor controlled to turn said straightener unit with said steel wire axially through a transmission mechanism.

3. The versatile spring making machine of claim 1 wherein said material guiding unit comprises a set of guiding rollers, a transmission mechanism driven by said motor of said feeder unit to turn said guiding rollers in delivering said steel wire, and a brake system controlled to release said guiding rollers from said steel wire.

* * * * *